US011279900B1

(12) United States Patent
Clark

(10) Patent No.: US 11,279,900 B1
(45) Date of Patent: Mar. 22, 2022

(54) CLEANING AGENT AND METHOD OF USING THE SAME

(71) Applicant: Nano-Tek Solutions LLC, Cle Elum, WA (US)

(72) Inventor: Dennis A. Clark, Star, ID (US)

(73) Assignee: Nano-Tek Solutions LLC, Cle Elum, WA (US)

( * ) Notice: Subject to any disclaimer, the term of this patent is extended or adjusted under 35 U.S.C. 154(b) by 9 days.

(21) Appl. No.: 16/152,178

(22) Filed: Oct. 4, 2018

Related U.S. Application Data

(60) Provisional application No. 62/568,163, filed on Oct. 4, 2017.

(51) Int. Cl.

| | |
|---|---|
| ***C11D 3/10*** | (2006.01) |
| ***C11D 3/08*** | (2006.01) |
| ***C11D 3/44*** | (2006.01) |
| ***C11D 3/04*** | (2006.01) |
| ***C11D 11/00*** | (2006.01) |
| ***C11D 3/37*** | (2006.01) |
| ***C11D 17/00*** | (2006.01) |

(52) U.S. Cl.
CPC ..... *C11D 3/10* (2013.01); *C11D 3/044* (2013.01); *C11D 3/08* (2013.01); *C11D 3/3707* (2013.01); *C11D 11/0023* (2013.01); *C11D 17/0073* (2013.01)

(58) Field of Classification Search
CPC ..... C11D 3/10; C11D 3/08; C11D 3/44
See application file for complete search history.

(56) References Cited

U.S. PATENT DOCUMENTS

| | | | | |
|---|---|---|---|---|
| 3,931,031 | A * | 1/1976 | Willard, Sr. | A61K 8/0291 510/418 |
| 4,395,344 | A * | 7/1983 | Maddox | C11D 3/39 134/2 |
| 6,218,351 | B1 * | 4/2001 | Busch | C11D 3/3932 510/311 |
| 6,299,701 | B1 * | 10/2001 | Aubay | C11D 3/08 134/25.2 |
| 8,071,528 | B2 * | 12/2011 | Smith | C11D 3/046 510/445 |
| 2002/0193270 | A1 * | 12/2002 | Cermenati | C11D 17/0056 510/302 |
| 2003/0162685 | A1 * | 8/2003 | Man | C11D 3/3945 510/445 |

(Continued)

FOREIGN PATENT DOCUMENTS

| | | | | |
|---|---|---|---|---|
| JP | 5426519 | B2 * | 2/2014 | C11D 3/0073 |

*Primary Examiner* — Mark Eashoo
*Assistant Examiner* — M. Reza-Asdjobi
(74) *Attorney, Agent, or Firm* — Polsinelli PC

(57) ABSTRACT

A cleaning agent for cleaning grease from a cooking apparatus includes nanoparticles and a chemical composition selected from the group consisting of sodium hydrate, sodium metasilicate, sodium carbonate, polyethylene glycol, surfactant, and combinations thereof. A method of cleaning a cooking apparatus containing used oil includes draining the used oil from the cooking apparatus, placing a cleaning agent in the drained cooking apparatus, filling the cooking apparatus with a predetermined amount of water, boiling the water containing the cleaning agent for a predetermine length of time, and draining the water containing the cleaning agent from the cooking apparatus.

20 Claims, 1 Drawing Sheet

(56) References Cited

U.S. PATENT DOCUMENTS

| | | | | |
|---|---|---|---|---|
| 2011/0112003 | A1* | 5/2011 | Mohs | C11D 3/044 510/218 |
| 2013/0045912 | A1* | 2/2013 | Morschhaeuser | C08G 63/6886 510/400 |
| 2013/0252872 | A1* | 9/2013 | Olson | C11D 3/3757 510/255 |
| 2016/0108388 | A1* | 4/2016 | Babe | D06L 4/40 435/221 |
| 2016/0122738 | A1* | 5/2016 | Babe | C12N 9/52 435/264 |

* cited by examiner

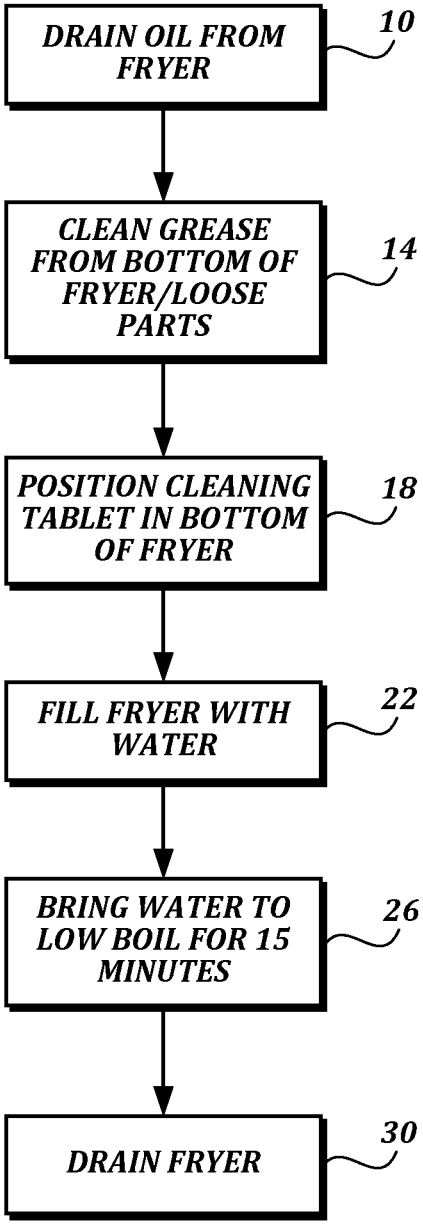
DRAIN OIL FROM FRYER
10
CLEAN GREASE FROM BOTTOM OF FRYER/LOOSE PARTS
14
POSITION CLEANING TABLET IN BOTTOM OF FRYER
18
FILL FRYER WITH WATER
22
BRING WATER TO LOW BOIL FOR 15 MINUTES
26
DRAIN FRYER
30

CLEANING AGENT AND METHOD OF USING THE SAME

CROSS-REFERENCE TO RELATED APPLICATION

This application claims the benefit of U.S. Provisional Patent Application No. 62/568,163, filed Oct. 4, 2017, the entire disclosure of which is incorporated herein by reference.

BACKGROUND

Fryer cleaners for restaurant-type deep fryers typically use caustic agents to clean the old grease from the fryers. Such caustic agents are potentially harmful to the users if not used properly and with care, and the caustic agents may leave chemical deposits in the fryers that may contaminate future cooking oil.

Moreover, traditional fryer cleaners rely on water or another material to carry/spread/infuse the cleaning agents into the grease and fryer parts. However, water cannot get into the microscopic pores of the fryer that become trapped with grease. The trapped grease requires energy to heat, which means that the oil in the fryer will take longer to heat up when it is replaced.

Therefore, there exists a need for an improved cleaning agent and a method of using the same to clean fryers or other similar cooking apparatuses or similar equipment.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A cleaning agent for cleaning grease from a cooking apparatus, comprising nanoparticles and a chemical composition selected from the group consisting of sodium hydrate, sodium metasilicate, sodium carbonate, polyethylene glycol, surfactant, and combinations thereof.

A method of cleaning a cooking apparatus containing used oil includes draining the used oil from the cooking apparatus, placing a cleaning agent in the drained cooking apparatus, filling the cooking apparatus with a predetermined amount of water, boiling the water containing the cleaning agent for a predetermine length of time, and draining the water containing the cleaning agent from the cooking apparatus.

DESCRIPTION OF THE DRAWINGS

The foregoing aspects and many of the attendant advantages of this disclosure will become more readily appreciated by reference to the following detailed description, when taken in conjunction with the accompanying drawings, wherein:

FIG. 1 is a flow chart depicting an exemplary method for cleaning a cooking apparatus with a cleaning agent formed in accordance with the present disclosure.

DETAILED DESCRIPTION

Embodiments of the present disclosure are directed to cleaning agents for cleaning grease from a cooking apparatus and methods of cleaning a cooking apparatus containing used oil. In one embodiment, a cleaning agent suitable for cleaning (i.e., removing the grease from) industrial deep fryers or other similar cooking apparatuses or similar equipment will now be described in detail. The cleaning agent may include one or more of the following components (or any well-known substitute components now known or later developed) in any suitable combination: sodium hydrate, sodium metasilicate, sodium carbonate, surfactant, polyethylene glycol, and nanoparticles. In one embodiment of the present disclosure, the cleaning agent includes nanoparticles and a chemical composition selected from the group consisting of sodium hydrate, sodium metasilicate, sodium carbonate, polyethylene glycol, surfactant, and combinations thereof.

In one embodiment of the present disclosure, a cleaning agent includes the ingredients listed in the table below.

| Ingredient | Percent by weight |
|---|---|
| Sodium hydrate | 40 weight percent +/− 5% |
| Sodium metasilicate | 25 weight percent +/− 5% |
| Sodium carbonate | 24 weight percent +/− 5% |
| Surfactant | 1 weight percent +/− 5% |
| Polyethylene glycol | 5 weight percent +/− 5% |
| Nanoparticles | 5 weight percent +/− 5% |

In another embodiment of the present disclosure, a cleaning agent includes the ingredients listed in the table below.

| Ingredient | Percent by weight |
|---|---|
| Sodium hydrate | 40 weight percent +/− 10% |
| Sodium metasilicate | 25 weight percent +/− 10% |
| Sodium carbonate | 24 weight percent +/− 10% |
| Surfactant | 1 weight percent +/− 10% |
| Polyethylene glycol | 5 weight percent +/− 10% |
| Nanoparticles | 5 weight percent +/− 10% |

Example

In one non-limiting example, the cleaning agent includes the following ingredients per one hundred pounds (100 lbs):

| Ingredient | Weight percent |
|---|---|
| Sodium hydrate | 40 weight percent |
| Sodium metasilicate | 25 weight percent |
| Sodium carbonate | 24 weight percent |
| Surfactant | 1 weight percent |
| Polyethylene glycol | 5 weight percent |
| Nanoparticles | 5 weight percent |

The inventor has found through extensive experimentation that the above cleaning agent ingredients, when combined together in specified amounts, act as a grease remover or degreaser in heated water. More specifically, sodium hydrate, sodium metasilicate, sodium carbonate, polyethylene glycol, and surfactant, when combined, act as a degreaser in boiling water.

In other embodiments, one of sodium hydrate, sodium metasilicate, sodium carbonate, polyethylene glycol, or surfactant may be eliminated or partially eliminated from the cleaning agent.

Nanoparticles include nanospheres, nanotubes, and any other shaped 2- and 3-dimensional particles having at least one dimension less than 1 micron. Suitable materials for nanoparticles include particles, such as Nano-additive powder (MTE), available from Enviro Science Technologies, or any other suitable materials for cleaning action in accordance with embodiments of the present disclosure.

The nanoparticles carry the cleaning agent ingredients (sodium hydrate, sodium metasilicate, sodium carbonate, polyethylene glycol, and surfactant) into the microscopic pores of the cooking fryer with the boiling action of the water to remove all the grease from the pores. As is known in the industry, suspensions of nanoparticles are possible because the interaction of the particle surface with the solvent (i.e., water) is strong enough to overcome density differences, which otherwise usually result in a material either sinking or floating in a liquid. In other words, the nanoparticles help dissolve the cleaning agent ingredients in the water for cleaning. Moreover, the high surface area to volume ratio of nanoparticles provides a tremendous driving force for diffusion, especially at elevated temperatures (such as at about 212° F. of boiling water). In other words, the nanoparticles carry the cleaning agent ingredients into the microscopic pores of the fryer (with the boiling action and heat of the water).

In a non-limiting example, the above-listed ingredients (sodium hydrate, sodium metasilicate, sodium carbonate, polyethylene glycol, surfactant, and nanoparticles) may be acquired in powder form and may be packaged in any suitable manner for use. For instance, the powder ingredients may be formed into a pressed powder tablet with a pressing machine. In that regard, the novel cleaning agent described above may be hereinafter referred to as a "cleaning tablet." In other embodiments, the powder ingredients may be enclosed within a pouch which is opened and dispensed by the user. In other embodiments, the powder ingredients may be enclosed within a dissolvable sack, similar to a dishwasher or washing machine pod. In yet other embodiments, the powder ingredients may be packaged in a larger container, with each dose measured out by the user with a designated scoop or other measuring device.

In one embodiment, cleaning tablets may be manufactured having a weight in the range of 2 to 2.5 ounces, which may be suitable for use with 4 to 5 gallons of water. For an example, a 2.25 ounce tablet may be suitable for use with about 4.54 gallons of water, which is an amount typically used in a 35 pound fryer. In that regard, in another example, a 4.5 ounce tablet may be suitable for use with about 9.08 gallons of water, which is an amount typically used in a 70 pound fryer.

Referring to FIG. 1, a non-limiting exemplary method of cleaning a deep fryer with a cleaning tablet formed in accordance with the present disclosure will be described. The exemplary method is described for a cleaning tablet suitable for cleaning a deep fryer. In a first step indicated by block 10, all the used oil is drained from the fryer. The sitting grease is cleaned from both the bottom of the fryer and the loose parts in the fryer, as indicated by block 14. A cleaning tablet is then positioned in the bottom of the fryer, as indicated by block 18, and the fryer is filled with water, as indicated by block 22. The water (with the cleaning tablet) is then brought to a low boil, in between about 200° F. and 220° F. (ideally about 212° F.), and boiled for about 10-20 minutes, such as about 15 minutes, as indicated by block 26. The boiling water is kept in between about 200° F. and 220° F. to prevent the water/cleaning tablet solution from boiling/foaming over the edge of the fryer. The temperature may be adjusted depending on altitude to maintain the water/cleaning tablet solution at a low boil for about 15-20 minutes. After about 15-20 minutes of boiling the water/cleaning tablet solution, the solution is drained from the fryer, as indicated by block 30, to reveal a substantially grease-free fryer.

The heat in the water creates the boiling action of the water that essentially "activates" the cleaning tablet. In other words, the swirling, bubbling water acts as a scrubbing action of the cleaning tablet ingredients within the fryer. Moreover, as noted above, the nanoparticles carry the cleaning agent ingredients into the microscopic pores of the fryer. More specifically, the swirling water carries the cleaning agent ingredients to the fryer surface, and the nanoparticles take the cleaning ingredients into the microscopic pores. The swirling water moves the nanoparticles/cleaning ingredients into and out of the pores to carry the grease away. In effect, the entire fryer is substantially free of grease after it is drained, as opposed to traditional fryer cleaners that cannot reach and clean the pores.

The above-described cleaning agent and method of using the same is safer and easier to use than the traditional method of cleaning with caustic agents. By simply boiling the cleaning tablet in water, no scrubbing, scouring, etc., is needed. Moreover, there is less or no contact with the cleaning agent, so exposure to the cleaning agent is minimized. In addition, the swirling, scrubbing action of the boiling water helps to carry away all grease and cleaning agent ingredients from the surface and pores of the fryer, minimizing build-up.

The detailed description set forth above in connection with the appended drawings is intended as a description of exemplary embodiments of the disclosed subject matter and is not intended to represent the only embodiments. The exemplary embodiments described in this disclosure are provided merely as examples or illustrations of a cleaning product and method and should not be construed as preferred or advantageous over other embodiments. The illustrative examples provided herein are not intended to be exhaustive or to limit the disclosure to the precise forms disclosed. Similarly, any features and/or process steps described herein may be interchangeable with other features and/or process steps, or combinations of features and/or process steps, in order to achieve the same or substantially similar result.

In the foregoing description, numerous specific details are set forth in order to provide a thorough understanding of the exemplary embodiment of the present disclosure. It will be apparent to one skilled in the art, however, that many embodiments of the present disclosure may be practiced without some or all of the specific details. In some instances, well-known features, ingredients, and/or process steps have not been described in detail in order not to unnecessarily obscure various aspects of the present disclosure. Further, it will be appreciated that embodiments of the present disclosure may employ any combination of features and/or process steps described herein. As a non-limiting example, the cleaning tablet may instead be added to the water after it has been brought to a boil.

Although certain descriptive terms are used to illustrate or describe certain aspects or benefits of the present invention, they should not be seen as limiting. For instance, the term "cleaning tablet" should be interpreted broadly to include any suitable form of the combined cleaning agent ingredients. Moreover, the term "grease" or "oil" should be interpreted broadly to include any suitable cooking oil (vegetable, canola, peanut, olive, safflower, avocado, etc.), cooking oil combined with food particles, synthetic and semi-synthetic oils, petroleum-based oils, oil blends, etc. In that regard, it can be appreciated that the above-described cleaning product and method of cleaning can be used on any other suitable oil-contaminated equipment, surfaces, parts, etc., other than cooking apparatuses such as a fryer.

In one example, the water/cleaning tablet solution that is removed from a fryer after use (as indicated by block 30 in FIG. 1) maybe poured on or otherwise used to treat oil-contaminated floors, driveways, etc. Other uses are also within the scope of the present disclosure.

The present disclosure may also reference quantities and numbers. Unless specifically stated, such quantities and numbers are not to be considered restrictive, but exemplary of the possible quantities or numbers associated with the present disclosure. The terms "substantially," "about," "approximately," etc., mean plus or minus 5% of the stated value.

While illustrative embodiments have been illustrated and described, it will be appreciated that various changes can be made therein without departing from the spirit and scope of the present invention.

The embodiments of the disclosure in which an exclusive property or privilege is claimed are defined as follows:

1. A cleaning agent for cleaning grease from a cooking apparatus, consisting of:

nanoparticles and a chemical composition selected from a group consisting of sodium hydrate, sodium metasilicate, sodium carbonate, polyethylene glycol, surfactant, and combinations thereof, wherein the nanoparticles and the chemical composition are formed into a pressed powder tablet; and wherein the cleaning agent consists of:

about 36-44 weight percent sodium hydrate;

about 22.5-27.5 weight percent sodium metasilicate;

about 21.6-26.4 weight percent sodium carbonate;

about 4.5-5.5 weight percent polyethylene glycol;

about 0.9-1.1 weight percent surfactant; and about 4.5-5.5 weight percent nanoparticles, wherein the chemical composition is free of additional caustic agents.

2. The cleaning agent of claim 1, wherein the cleaning agent comprises:

about 4.75-5.25 weight percent nanoparticles.

3. The cleaning agent of claim 1, wherein the cleaning agent comprises:

about 38-42 weight percent sodium hydrate.

4. The cleaning agent of claim 1, wherein the cleaning agent comprises:

about 23.75-26.25 weight percent sodium metasilicate.

5. The cleaning agent of claim 1, wherein the cleaning agent consisting of:

about 22.8-25.2 weight percent sodium carbonate;

about 4.75-5.25 weight percent polyethylene glycol; and about 0.95-1.05 weight percent surfactant.

6. The cleaning agent of claim 1, wherein the nanoparticles are nanospheres, nanotubes, or a combination thereof.

7. The cleaning agent of claim 1, wherein the cleaning agent consists of:

about 38-42 weight percent sodium hydrate;

about 23.75-26.25 weight percent sodium metasilicate;

about 22.8-25.2 weight percent sodium carbonate;

about 4.75-5.25 weight percent polyethylene glycol;

about 0.95-1.05 weight percent surfactant; and about 4.75-5.25 weight percent nanoparticles.

8. The cleaning agent of claim 1, wherein the pressed powder tablet is about 2.25 ounces.

9. The cleaning agent of claim 1, wherein the pressed powder tablet is about 4.5 ounces.

10. A cleaning agent for cleaning grease from a cooking apparatus, consisting of:

a chemical composition consisting of:

about 36-44 weight percent sodium hydrate;

about 22.5-27.5 weight percent sodium metasilicate;

about 21.6-26.4 weight percent sodium carbonate;

about 4.5-5.5 weight percent polyethylene glycol;

about 0.9-1.1 weight percent surfactant; and about 4.5-5.5 weight percent nanoparticles, wherein the nanoparticles are configured to carry the chemical composition ingredients into microscopic pores of the cooking apparatus when the cleaning agent is boiled in water in the cooking apparatus, wherein the chemical composition is free of additional caustic agents.

11. The cleaning agent of claim 10, wherein the chemical composition consists of:

about 38-42 weight percent sodium hydrate;

about 23.75-26.25 weight percent sodium metasilicate;

about 22.8-25.2 weight percent sodium carbonate;

about 4.75-5.25 weight percent polyethylene glycol;

about 0.95-1.05 weight percent surfactant; and about 4.75-5.25 weight percent nanoparticles.

12. The cleaning agent of claim 10, wherein the nanoparticles are nanospheres, nanotubes, or a combination thereof.

13. A pressed powder cleaning tablet for cleaning grease from a cooking apparatus, consisting of:

a cleaning agent consisting of nanoparticles and a chemical composition selected from a group consisting of sodium hydrate, sodium metasilicate, sodium carbonate, polyethylene glycol, surfactant, and combinations thereof;

wherein the nanoparticles are configured to carry the chemical composition into microscopic pores of the cooking apparatus when the cleaning agent is boiled in water in the cooking apparatus.

14. The pressed powder cleaning tablet of claim 13, further consisting of:

about 36-44 weight percent sodium hydrate;

about 22.5-27.5 weight percent sodium metasilicate;

about 21.6-26.4 weight percent sodium carbonate;

about 4.5-5.5 weight percent polyethylene glycol;

about 0.9-1.1 weight percent surfactant; and about 4.5-5.5 weight percent nanoparticles.

15. The pressed powder cleaning tablet of claim 13, wherein the nanoparticles are nanospheres, nanotubes, or a combination thereof.

16. The pressed powder cleaning tablet of claim 13, wherein the pressed powder cleaning tablet is about 2.25 ounces.

17. The pressed powder cleaning tablet of claim 13, wherein the pressed powder cleaning tablet is about 4.5 ounces.

18. A cleaning agent for cleaning grease from a cooking apparatus, the cleaning agent consists of:

about 36-44 weight percent sodium hydrate;

about 22.5-27.5 weight percent sodium metasilicate;

about 21.6-26.4 weight percent sodium carbonate;

about 4.5-5.5 weight percent polyethylene glycol;

about 0.9-1.1 weight percent surfactant; and about 4.5-5.5 weight percent nanoparticles.

19. The cleaning agent of claim 18, wherein the chemical composition consists of:

about 38-42 weight percent sodium hydrate;

about 23.75-26.25 weight percent sodium metasilicate;

about 22.8-25.2 weight percent sodium carbonate;

about 4.75-5.25 weight percent polyethylene glycol;

about 0.95-1.05 weight percent surfactant; and about 4.75-5.25 weight percent nanoparticles.

20. The cleaning agent of claim 18, wherein the nanoparticles are nanospheres, nanotubes, or a combination thereof.

* * * * *